US006748894B1

(12) United States Patent
Dunn et al.

(10) Patent No.: US 6,748,894 B1
(45) Date of Patent: Jun. 15, 2004

(54) SUBMERSIBLE MARINE VEHICLE

(76) Inventors: Adam Peter Dunn, 117 Morris St., Sebastopol, CA (US) 95472; Scott Roberts Kalkman, 117 Morris St., Sebastopol, CA (US) 95472; Gary Starr, 117 Morris St., Sebastopol, CA (US) 95472; James R. Jeremias, 117 Morris St., Sebastopol, CA (US) 95472

( * ) Notice: Subject to any disclaimer, the term of this patent is extended or adjusted under 35 U.S.C. 154(b) by 0 days.

(21) Appl. No.: 10/057,209

(22) Filed: Jan. 22, 2002

(Under 37 CFR 1.47)

Related U.S. Application Data

(60) Provisional application No. 60/262,856, filed on Jan. 19, 2001.

(51) Int. Cl.[7] ..... B63C 11/46
(52) U.S. Cl. ..... 114/315; 440/6
(58) Field of Search ..... 114/315; 440/6

(56) References Cited

U.S. PATENT DOCUMENTS 5,105,753 A * 4/1992 Chih et al. ..... 114/315
5,303,666 A * 4/1994 DeSantis et al. ..... 114/315
5,423,278 A * 6/1995 Lashman ..... 114/315
5,469,803 A * 11/1995 Gallo ..... 114/315
5,634,423 A * 6/1997 Lashman ..... 114/315
5,704,817 A * 1/1998 Vaughn ..... 440/33
D453,726 S * 2/2002 Dunn et al. ..... D12/308

* cited by examiner

*Primary Examiner*—Stephen Avila
(74) *Attorney, Agent, or Firm*—Jay P. Hendrickson

(57) ABSTRACT

The present invention generally includes a submersible marine vehicle for recreational use in which a propeller and motor assembly is disposed within the vehicle's hull and a battery is disposed beneath the hull. The front end of the hull contains a plurality of inlets and the back end contains a plurality of outlets. The propeller and motor assembly is disposed within the hull such the propeller is adjacent to the hull's front end and the motor is adjacent to the hull's back end. Each propeller blade has its leading edge aft of its trailing edge. The hull includes a pair of fins which are integral with the hull, each fin extending horizontally and away from the hull. Each fin contains a hand hold, extending downwardly and away from the underside surface of the fin. A pair of curved tracking fins are attached to opposite sides of the bottom side of the hull, each curved tracking fin extending outwardly and downwardly away from the hull. A water-tight housing, attached to the bottom of the hull, contains two compartments: one compartment holds a battery which powers the propeller and motor assembly, and which provides ballast to the vehicle, and the other compartment contains buoyant material in order to provide buoyancy to the vehicle.

19 Claims, 5 Drawing Sheets

SECTION A-A

SUBMERSIBLE MARINE VEHICLE

TECHNICAL FIELD OF THE INVENTION

The present invention relates to the technical field of submersible marine vehicles.

BACKGROUND OF THE INVENTION

Submersible marine vehicles which are designed to be operated by a swimmer or diver at underwater depths of several hundred feet are now well known in the art. Two notable examples are disclosed in U.S. Pat. Nos. 5,423,278 and 5,634,423, both issued to Lashman. Each of these inventions generally includes a submersible marine vessel, operable both upon and beneath the water. Each vessel includes a water-tight hull elongated along a longitudinal axis corresponding to an intended direction of travel. The hull also has a pair of lateral hand gripping means or handles, and a velocity control switch is operably associated with each handle. A battery, disposed with the fluid-tight hull, provides power to a motor/propeller assembly. The motor/propeller assembly is generally disposed within a protective shroud which is integral with and extends downwardly from the underside of the hull.

Recreational versions of the above patents exhibit similar designs. For example, in U.S. Pat. No. 5,105,753 issued to Chih, et al., comprises a water-tight main body or hull containing a battery, but the motor/propeller assembly is disposed within a shroud which is behind and in axial alignment with the hull.

These prior art marine vehicle designs have several limitations, especially when the designs are applied to recreational users who are not well trained in the safe operation of a marine vehicle. A significant limitation is that the propeller is positioned such that the operator's fingers or hand may come in contact with the rotating propeller, causing severe bodily injury. Another limitation is that the designs are, in general, bulky in that the propeller compartment is separated from the water-tight hull.

The present invention provides a marine vehicle for recreational use which overcomes the limitations described above and provides several other advantages.

SUMMARY OF THE INVENTION

The present invention generally includes a submersible marine vehicle for recreational use in which a propeller and motor assembly is disposed within the vehicle's hull and a battery is disposed beneath the hull. More specifically, the front end of the hull contains a plurality of inlets and the back end contains a plurality of outlets. However, the inlets and outlets are not large enough to permit a user's hand or fingers to come into contact with the propeller. The propeller and motor assembly is disposed within, rather than below, the hull such the propeller is adjacent to the hull's front end and the motor is adjacent to the hull's back end. The propeller has at least one propeller blade, with the blade having a leading edge aft of a trailing edge.

The hull also includes a pair of fins which are integral with the hull, each fin extending horizontally and away from the hull. Each fin contains a hand hold, extending downwardly and away from the underside surface of the fin. A pair of curved tracking fins are attached to opposite sides of the bottom side of the hull, each curved tracking fin extending outwardly and downwardly away from the hull.

A water-tight housing, attached to the bottom of the hull, contains two compartments: one compartment holds a battery which powers the propeller and motor assembly, and which provides ballast to the vehicle, and the other compartment contains buoyant material in order to provide buoyancy to the vehicle.

BRIEF DESCRIPTION OF THE DRAWINGS

The present invention is illustrated by reference to the following figures.

DETAILED DESCRIPTION OF THE INVENTION

Figure 1:
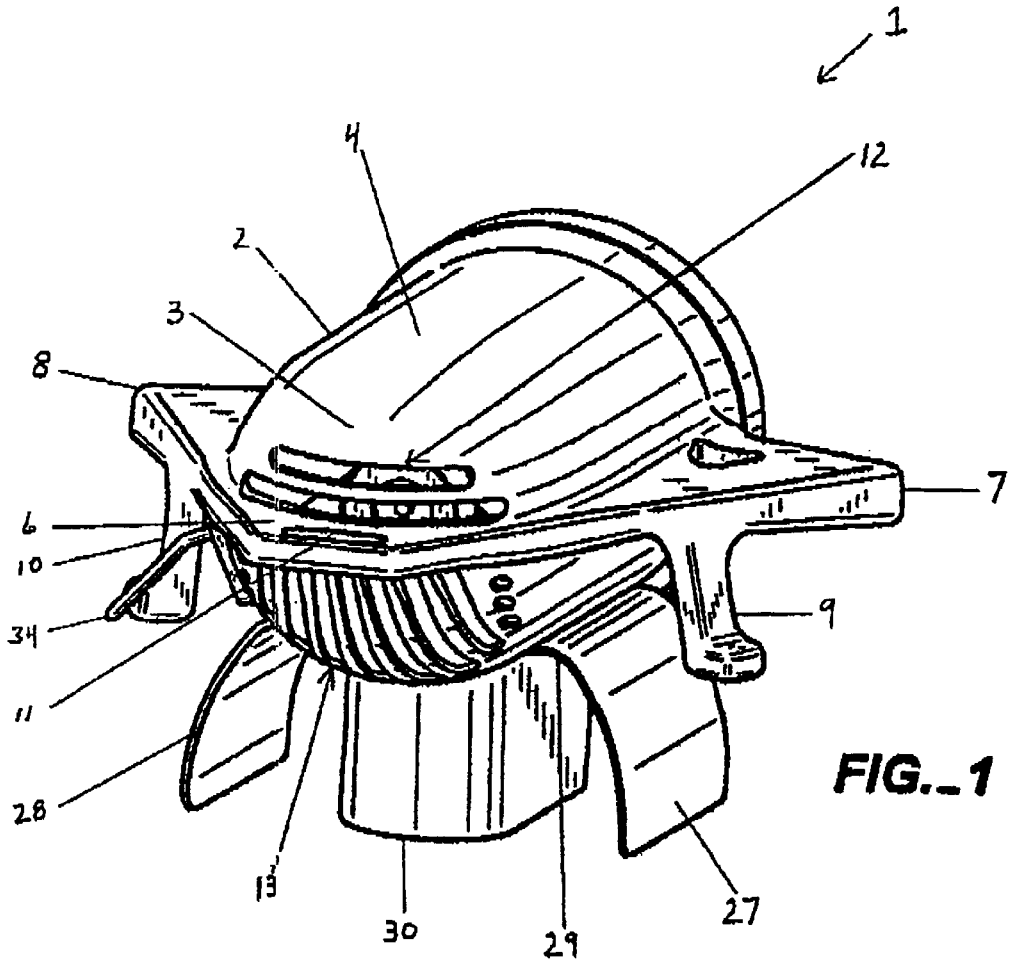
FIG. 1 is a front perspective view of the submersible vehicle.
Figure 2:
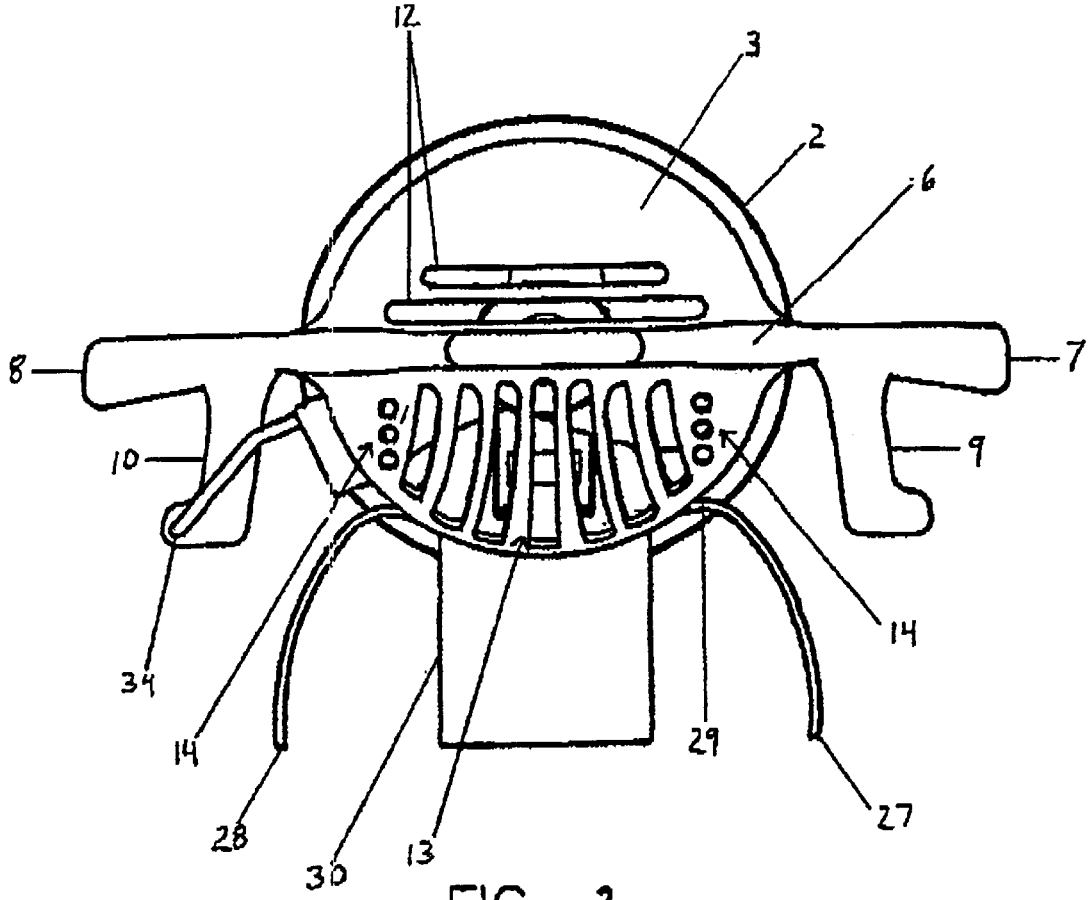
FIG. 2 is a front view of the submersible vehicle.
Figure 5:
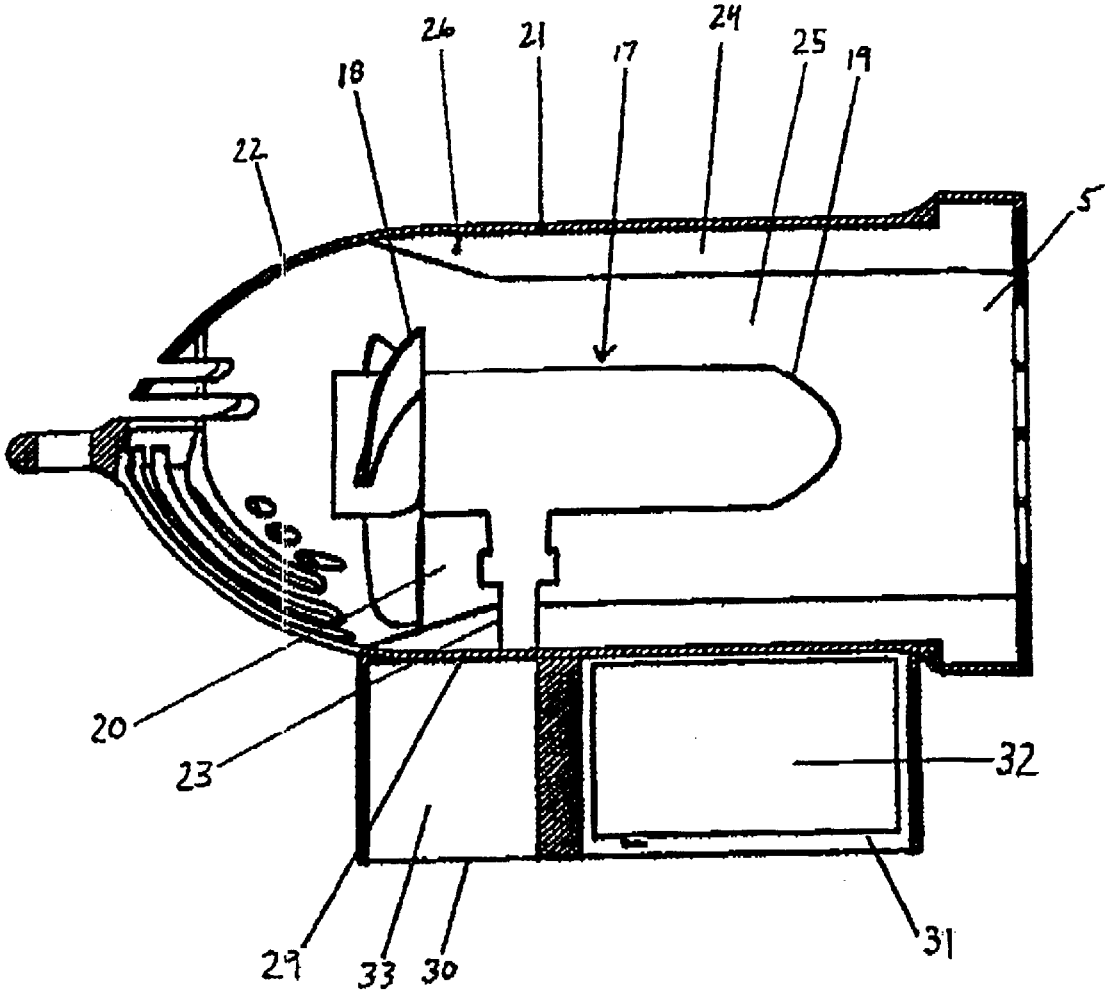
FIG. 5 is a cross-sectional view of the submersible vehicle along line A—A.

Referring generally to FIG. 1 and FIG. 2, the present invention is a submersible marine vehicle 1 comprising a bullet-shaped hull 2, approximately symmetrical about a horizontal hull axis, with the hull 2 having a rounded front end 3 section, a cylindrical center 4 section and, a circular opening 5 at a back end. The hull has a cylindrically shaped inside surface 21 and rounded front end inside surface 22, which define a hull cavity 20. The shape of the hull cavity 20 is illustrated in FIG. 5.

A solid horizontal member 6, which is integral with the hull, extends in a horizontal plane outwardly from the hull 2 and forms a pair of horizontal fins 7 and 8 which are joined at the hull's rounded front end 3 section and which extend back and widen towards the circular opening 5 at the hull's back end. The solid horizontal member 6 separates a top half of the hull 2 from an approximately symmetrical bottom half of the hull 2. The solid horizontal member 6, in addition to forming a pair of horizontal fins 7 and 8, has a pair of hand holds 9 and 10, with each hand hold being integral with and extending vertically downward from the underside of its respective fin. A carrying hand hold 11 is defined by an opening through the horizontal member 6, adjacent to the rounded front end 3 section of the hull 2.

Two (2) approximately parallel and horizontal top inlet slots 12 define openings through the rounded front end 3 section, within the top half of the hull 2, and seven (7) approximately parallel, vertical and equally spaced bottom inlet slots 13 similarly define openings through the hull's rounded front end 3 section, within the bottom half of the hull. Two (2) of the bottom inlet slots 13 comprise end slots, with the other five (5) bottom inlet slots 13 positioned between the two end slots. Six (6) inlet portholes 14 define openings through the hull's rounded front end 3 section-, within the bottom half of the hull 2. Three (3) of the inlet portholes 14, which are approximately vertically aligned, evenly spaced, and substantially similar, are located adjacent to one of the end slots, and the other three (3) inlet portholes 14, which are also approximately vertically aligned, evenly spaced and substantially similar, are located adjacent to the other end slot. The axis of each inlet porthole 14 is approximately parallel to the hull axis. The inlet slots and inlet portholes are provided in order to permit water to flow through the hull's rounded front end 3 section and into the hull cavity 20.

A pair of curved, symmetrical tracking fins 27 and 28 are disposed under the hull, and top portions of the tracking fins are joined together to form a circumferentially curved fin plate 29 which is mated to and attached to the hull's bottom half. Each curved tracking fin extends outwardly and downwardly from the hull's bottom half. An elongated, rectangularly shaped and water-tight housing 30 with a rounded front-end is centrally disposed between the pair of tracking fins 27 and 28. The housing's top side is circumferentially curved and is mated and attached to the circumferentially curved fin plate 29. The pair of symmetrical tracking fins 27 and 28 and housing 30 are each aligned under the hull's bottom half such that the tracking fins and housing are symmetrical around the same vertical plane, which is also co-extensive with the hull axis.

In a preferred embodiment, the hull 2, pair of horizontal fins 7 and 8, pair of hand holds 9 and 10, and pair of tracking fins 27 and 28 are made of high density polyethylene.

Figure 3:
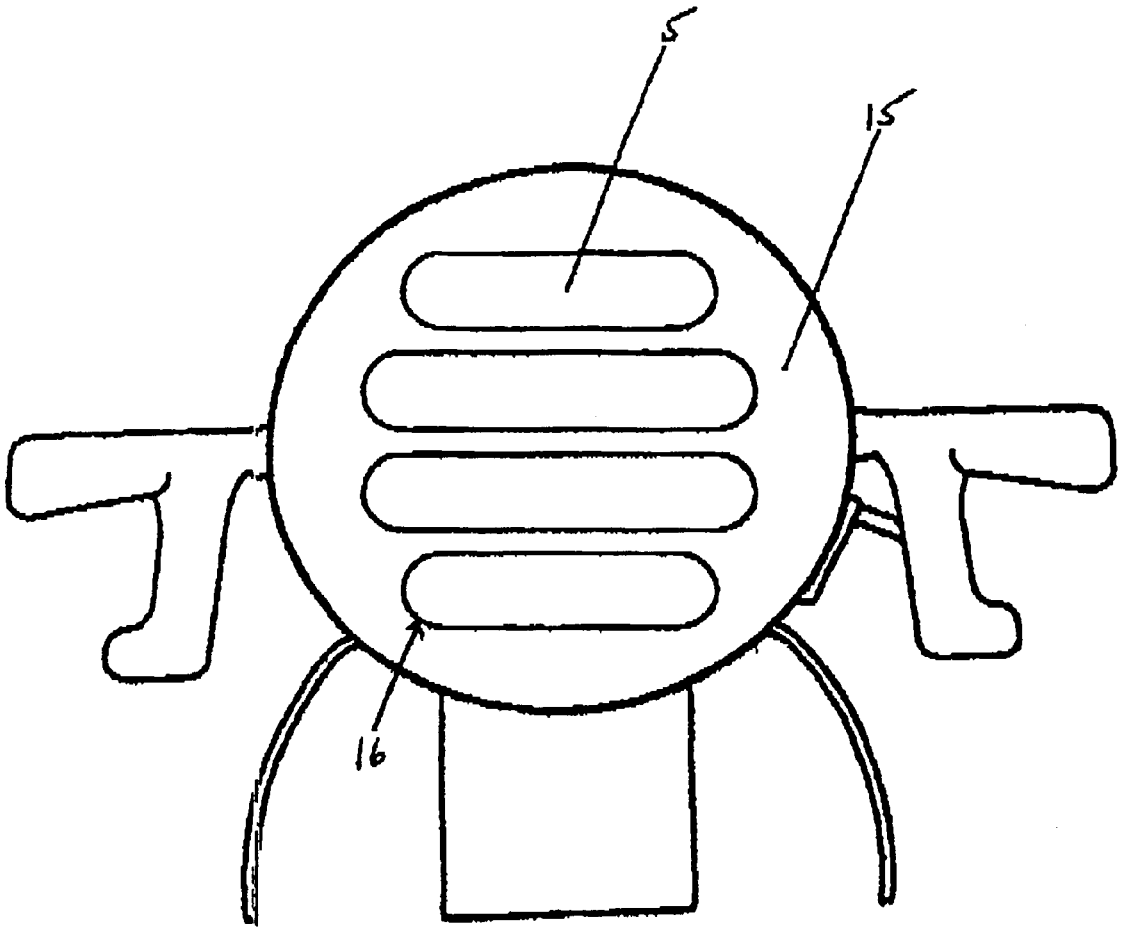
FIG. 3 is a back view of the submersible vehicle.

Referring to FIG. 3, a circularly shaped back-end cover plate 15 is disposed within the hull's circular opening 5 and is attached to the hull 2 by means of a plurality of clamps (not shown). The back-end cover plate 15 contains four approximately parallel, horizontal, and equally spaced end cover plate outlet slots 16. The outlet slots 16 are provided to permit the water that has entered the hull cavity 20 through the inlet slots and inlet portholes to exit the hull cavity 20.

Figure 4:
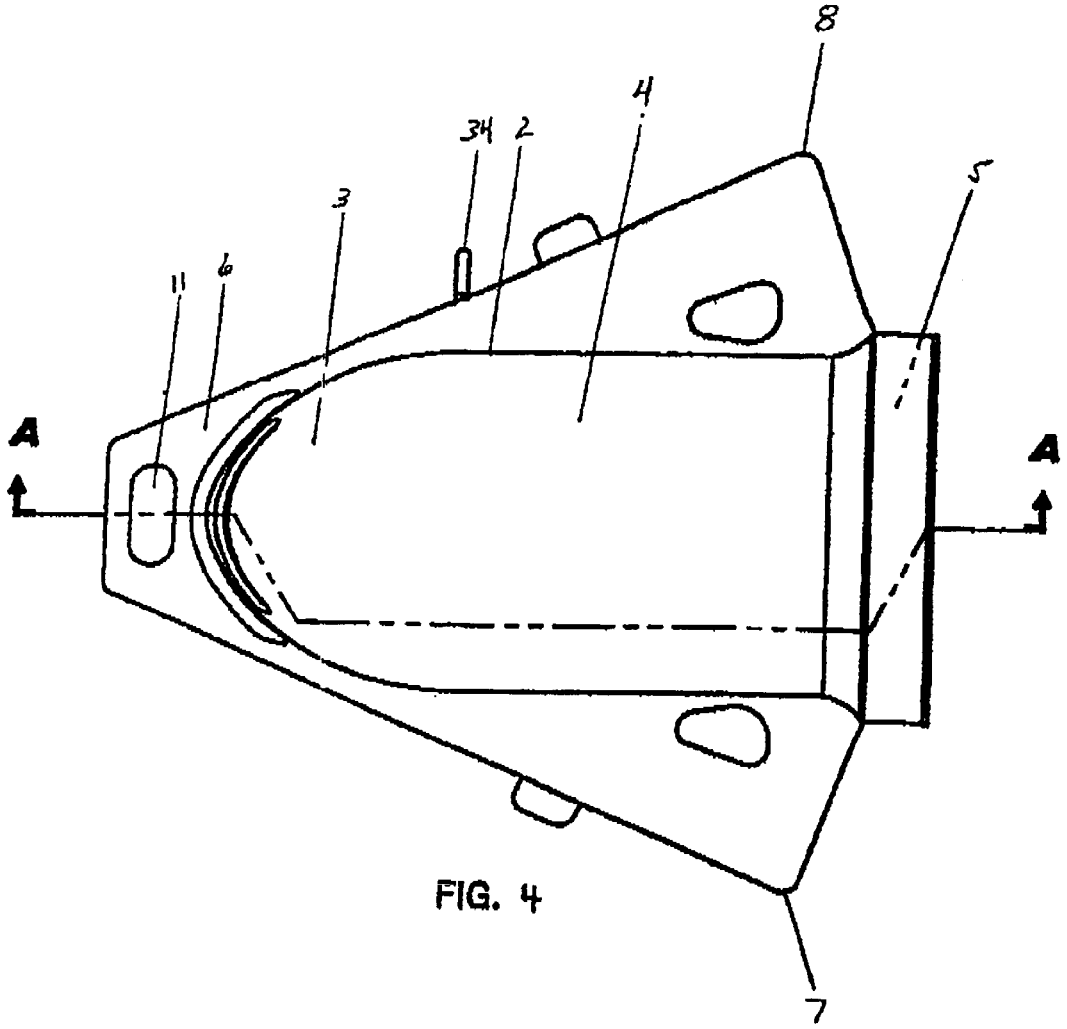
FIG. 4 is a top view of the submersible vehicle, showing cross-section line A—A.

Referring to FIGS. 4 and 5, a propeller and motor assembly 17, having a propeller 18 and a motor 19, is disposed within the hull cavity 20, such that both the axis of the propeller and the axis of the motor, which are in axial alignment, are approximately collinear with the hull axis.

The propeller 18, having three propeller blades, is positioned adjacent to the hull's rounded front-end inside surface 22, and the motor 19 is positioned adjacent to the back-end cover plate 15. The propeller and motor assembly 17 is secured in its position within the hull's cavity 20 by means of a vertical support member 23 attached at its top end to the underside of the assembly 17 and at its opposite end to the bottom of the hull's cylindrically shaped inside surface 21. The propeller blades are configured within the assembly 17 such that the leading edge of each propeller blade is aft of the trailing edge. Thus, as water flows through the inlet slots 12 and 13 and inlet portholes 14, and into the hull cavity 20, the water first contacts the propeller blade's trailing edge. Although this propeller configuration is less efficient in crating an initial pressure differential access the propeller, the configuration has the advantage of reducing the initial acceleration of the vehicle, which is much safer and easier to operate by recreational users.

Adjacent to the hull's cylindrically shaped inside surface 21 and surrounding the propeller and motor assembly 17 is a solid, but light weight, elongated encasement 24 which depends radially from the hull's inside surface 21 and defines an elongated and rectangularly shaped encasement cavity 25 surrounding the assembly 17. Preferably, the encasement 24 is made of high density, plastic coated form. The front end of the elongated encasement 24 tapers to the hull's cylindrically shaped inside surface 21, forming a tapered encasement 26 section, and the back end of the elongated encasement 24 terminates approximately at the circular opening 5 at the hull's back end. The propeller and motor assembly 17 is positioned within the encasement cavity 25 such that the propeller is approximately adjacent to the tapered encasement 26 section.

The interior portion of the housing 30 contains a battery 32 which is positioned in a ballast compartment 31 towards the back of the housing 30, and the front portion of the housing contains a buoyant compartment, filled with polystyrene plastic, or some other light weight buoyant material. The battery 32 supplies electrical power to the propeller and motor assembly 17, which is activated by means of a magnetically controlled toggle switch 34 (e.g., "reed" switch), which extends outwardly from either the right or left side of the bottom half of the hull and adjacent to a vertical hand hold.

In operation, when the submersible marine vehicle is placed in the water, the water-tight housing 30, including the buoyant compartment 33 and ballast compartment 31, acts to both vertically align the vehicle and provide sufficient buoyancy, such that the vehicle floats approximately level, with either a zero or slight positive angle of attack above the water level. In this position the water level covers the top horizontal inlet slot, but does not completely cover the top half of the hull. A user positions himself or herself behind the back-end plate, grips the two hand holds, and points the hull's front end 3 section in the direction of travel. Simultaneously, the propeller and motor assembly 17 is activated by operating the toggle switch 34. As the user pushes the vehicle forward through the water, the rotating propeller 18 creates a pressure differential across the propeller 18 and water begins to flow through the inlet slots 12 and 13 and portholes 14, towards the hull's back-end cover plate 15 and through the outlet slots 16. The force with which the water exits the outlet slots 16 creates an equal and opposite force on the vehicle, propelling the vehicle in a forward direction along the surface of the water. The vehicle is also readily submerged by simply pointing the hull's front end 3 section in a downward, underwater direction.

Several novel features of the present invention combine to produce a submersible marine vehicle which is significantly improved over previous designs. The primary improvement is that the present invention encloses the propeller and motor assembly inside of the vehicle's hull, rather than outside of the hull. This design significantly improves the safety of the vehicle since the user's hand and fingers, and other extremities, cannot come into contact with the propeller. The design also causes the marine vehicle to be pulled through the water, rather than pushed, as in propeller's designed for other marine vehicles. This pulling action, combined with the location of the propeller, provides a substantial benefit to the user due to reduced strain on the user's wrist and arms. Further, the propeller is disposed within the hull cavity such that each propeller blade's leading edge is aft of the trailing edge rather than having a more traditional configuration with the trailing edge aft of the leading edge. Although the traditional propeller configuration is more efficient in creating a substantial pressure differential across the propeller's plane of rotation, the configuration has the disadvantage of potentially causing the vehicle to start moving suddenly and abruptly. The propeller configuration of the present invention, however, does not create the same substantial pressure differential when it first starts rotating. This feature of the present invention is utilized so that, upon activation of the propeller, the vehicle is not powered by the propeller until the user has pushed it forward a sufficient distance to fill the hull's cavity with water. As the cavity fills, the efficiency of the propeller increases, until it reaches its operational efficiency. Finally, the efficiency of the propeller is enhanced by the addition of the tapered section of the encasement surrounding the propeller. This tapered section causes an increase in the velocity of the water as it enters the propeller's plane of rotation, and this increase in water velocity increases the pressure differential across the propellers, which in turn increases the exit velocity of the water through the outlet slots, and which in turn increases the velocity of the vehicle.

The utility and efficiency of the present invention are further enhanced due to other novel features. The two horizontal inlet slots on the hull's front end are positioned such that when the user turns the vehicle, water continues to flow uniformly through the hull cavity. If the slots were replaced with portholes, the portholes would not provide a continuous flow of water to the hull's cavity. The vertical inlet portholes located on the bottom of the hull assist in maintaining a uniform flow of water through the hull before passing through the outlet slots. The pair of curved fins and housing provide for enhanced tracking and stability, as compared to the stability provided by single or dual fins. Further, the housing functions as a keel, and provides ballast and buoyancy to the vehicle.

Another feature of the present invention is that the vehicle is self-righting in that no matter how the unit is placed in the water, it will always float to the surface and right itself. This functionality is due to the unique motor-over-battery design in which the vertical plane of symmetry of the battery is co-extensive with the axis of the hull and the axis of the propeller and motor assembly. An additional feature of having the battery below and outside of the vessel's hull is that the battery can be easily and quickly changed.

Another important feature of the present invention is the design of the circular end plate. Although the design of the end plate, as described above, contains four rows of outlet slots, several other configurations are possible. For example, if the hull's interior encasement formed a cylindrical shape around the propeller and motor assembly, rather than a rectangular shape, the outlet slots could be replaced with portholes arranged in a circle. Further, the end plate may be provided with an adjustable means, permitting the user to partially cover or uncover the outlets, and in this manner modify the volume of water exiting through the outlets. By adjusting the size and location of the outlet openings, the user may alter the velocity, acceleration and maneuverability of the vehicle.

While the present invention has been described with reference to a few embodiments, the description is illustrative of the invention and is not to be construed as limiting the invention. Various modifications may occur to those skilled in the art without departing from the scope of the invention as defined by the appended claims.

What is claimed is:

1. A submersible vehicle comprising:

a) a hull having a front end, back end, top side, bottom side, outside surface and inside surface, said inside surface defining a hull cavity;

b) a plurality of inlets contained within the front end of the hull, whereby the inlets allow water or other liquid to flow into the hull cavity;

c) a plurality of outlets contained within the back end of the hull, whereby the outlets allow water or other liquid to flow out of the hull cavity;

d) a propeller and motor assembly disposed within the hull cavity, said propeller having at least one propeller blade having a leading edge and a trailing edge;

e) a housing attached to the bottom side of the hull, said housing containing a front compartment and a back compartment, said front compartment containing a buoyant material and said back compartment containing an energy source used to power the motor;

f) a pair of fins integral with and extending horizontally away from said hull;

g) a pair of hand holds integral with the bottom surface of said pair of fins; and h) a pair of tracking fins attached to opposite sides of the bottom side of the hull, each tracking fin extending outwardly and downwardly away from the hull.

2. The submersible vehicle of claim 1 in which the plurality of inlets includes two approximately horizontal and parallel top inlet slots located within the top side of the hull.

3. The submersible vehicle of claim 1 in which the plurality of inlets includes seven approximately vertical and parallel bottom inlet slots located within the bottom side of the hull.

4. The submersible vehicle of claim 1 in which the plurality of inlets includes six inlet portholes located within the bottom side of the hull, wherein three of the portholes, located on one side of the hull, are approximately vertically aligned and evenly spaced, and the other three portholes, located on the other side of the hull, are approximately vertically aligned and evenly spaced.

5. The submersible vehicle of claim 1 in which the plurality of outlets comprises four approximately horizontal and parallel back outlet slots.

6. The submersible vehicle of claim 1 in which the front end of the hull has a rounded bullet shape.

7. The submersible vehicle of claim 1 in which the back end of the hull comprises a circularly shaped opening, with a circularly shaped disk disposed within the opening, said disk containing the plurality of outlets.

8. The submersible vehicle of claim 7 in which the plurality of outlets comprises four approximately horizontal and parallel back outlet slots.

9. The submersible vehicle of claim 1 in which the propeller and motor assembly is disposed within the hull cavity such that the propeller is adjacent to the hull's front end and the motor is adjacent to the hull's back end.

10. The submersible vehicle of claim 9 in which the leading edge of the at least one propeller blade is adjacent to the motor and the trailing edge of the at least one propeller blade is adjacent to the hull's front end, whereby the propeller blade's leading edge is aft of the trailing edge.

11. The submersible vehicle of claim 1 in which the hull is approximately symmetrical about a horizontal hull axis.

12. The submersible vehicle of claim 11 in which the propeller axis and motor axis are in axial alignment and are approximately colinear with the hull axis.

13. The submersible vehicle of claim 12 in which an elongated encasement having a front and back end, depends radially from the hull's inside surface, said encasement defining a rectangularly shaped encasement cavity surrounding the propeller and motor assembly.

14. The submersible vehicle of claim 13 in which the front end of the encasement tapers from the encasement cavity to the inside surface of the hull, forming an encasement tapered section.

15. The submersible vehicle of claim 14 in which the propeller is adjacent to said encasement tapered section.

16. The submersible vehicle of claim 1 in which the housing's energy source is a battery in electrical connection with the motor.

17. The submersible vehicle of claim 1 in which the buoyant material is polystyrene plastic.

18. The submersible vehicle of claim 1 in which the hull is made of high density polyethylene.

19. The submersible vehicle of claim 13 in which the elongated encasement is made of high density plastic coated foam.

* * * * *